US006433320B2

(12) United States Patent
Bartoletti et al.

(10) Patent No.: US 6,433,320 B2
(45) Date of Patent: Aug. 13, 2002

(54) ON-DEMAND MICROWAVE HEATING SYSTEM AND METHOD

(75) Inventors: Larry Bartoletti, Northfield; Balakrishna Reddy, Ridgefield, both of CT (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 09/933,853

(22) Filed: Aug. 21, 2001

Related U.S. Application Data

(63) Continuation of application No. PCT/EP00/01735, filed on Feb. 25, 2000, which is a continuation-in-part of application No. 09/258,767, filed on Feb. 26, 1999, now abandoned.

(51) Int. Cl.[7] ..... H05B 6/78

(52) U.S. Cl. ..... 219/679; 219/687; 219/693; 219/745; 219/756; 219/762; 221/150 A; 222/146.2; 99/DIG. 14; 426/241

(58) Field of Search ..... 219/679, 687, 219/689, 691, 693, 685, 756, 762, 745; 221/150 A, 150 HC; 222/146.2, 146.5; 99/DIG. 14, 451; 426/107, 241, 243

(56) References Cited

U.S. PATENT DOCUMENTS

| | | | | |
|---|---|---|---|---|
| 2,467,230 A | * | 4/1949 | Revercomb et al. | 219/693 |
| 2,585,970 A | | 2/1952 | Shaw | 99/221 |
| 2,650,291 A | * | 8/1953 | Kinn | 219/693 |
| 3,336,142 A | | 8/1967 | Lawson | 99/192 |
| 4,037,071 A | | 7/1977 | Kaufman, Jr. et al. | 219/10.55 F |
| 4,360,129 A | | 11/1982 | Brokaw et al. | 222/146 H |
| 4,446,988 A | | 5/1984 | Chronis | 222/63 |
| 4,509,450 A | | 4/1985 | Jondahl | 118/20 |
| 4,689,119 A | | 8/1987 | Weldon | 162/281 |
| 4,760,228 A | * | 7/1988 | Kudo | 219/693 |
| 4,957,226 A | | 9/1990 | Pacia | 222/643 |
| 4,967,486 A | | 11/1990 | Doelling | 34/1 |
| 5,040,700 A | | 8/1991 | Compton | 222/146.5 |
| 5,589,093 A | | 12/1996 | Chen | 219/679 |
| 5,719,380 A | * | 2/1998 | Coopes et al. | 219/687 |

FOREIGN PATENT DOCUMENTS

| | | |
|---|---|---|
| CH | 679722 | 3/1992 |
| DE | 30 18 956 | 11/1981 |
| EP | 196 739 | 10/1986 |
| JP | 62186770 | 8/1987 |

* cited by examiner

*Primary Examiner*—Philip H. Leung
(74) *Attorney, Agent, or Firm*—Winston & Strawn

(57) ABSTRACT

A dispenser for dispensing a heated wet food or beverage product that includes a housing capable of receiving the product, a heating device including an electrical power supply and a magnetron configured to supply electromagnetic energy in the microwave range to a wave-guide, and a heating passage configured to supply the product on-demand and arranged to intersect the wave-guide to heat the product when electromagnetic energy is applied within the wave-guide. The invention aims to prevent degradation and microbiological contamination of the product by maintaining it at ambient temperature and then heating and dispensing it only on-demand.

22 Claims, 3 Drawing Sheets

ON-DEMAND MICROWAVE HEATING SYSTEM AND METHOD

CROSS-REFERENCE TO RELATED APPLICATIONS

This application is a continuation of International Application No. PCT/EP00/01735, filed on Feb. 25, 2000, which is a continuation in part of U.S. application Ser. No. 09/258,767, filed on Feb. 26, 1999, now abandoned. The content of each of these related applications is expressly incorporated herein by reference thereto.

FIELD OF INVENTION

The present invention relates to a heater for heating and reconstitution of wet food or beverage products, and more specifically, to a dispenser that includes such a heater.

BACKGROUND OF INVENTION

Conventional dispensers of hot wet food products such as sauce, e.g., cheese and tomato sauce, have product storage tanks, commonly made of stainless steel, to hold the product and heating rods which heat the product in the storage tank. The wet product is commonly supplied in bags or packages, which are arranged in the tank and connected to a dispenser outlet.

These conventional hot dispensers suffer from a number of drawbacks. For instance, they require a lengthy cold start period during which the tank filled with unheated wet product must be heated. They also require a long recovery time when heated wet product is dispensed, if replenish with unheated wet product. If the product-holding bag is not replenished, it is necessary to regulate the temperature of the heating rods.

In connection with the re-thermalization or reheating of food products, it is further a serious drawback that the product quality tends to degrade over time when kept at a high temperature for prolonged period of time.

Furthermore, microbiological safety is a serious concern once the bag or package has been opened, and is then maintained at an elevated temperature.

In order to overcome the above drawbacks, some conventional food dispensers include on-demand heaters. These conventional on-demand dispensers only heat the product when requested. Conventional on-demand heating dispensers include electrical resistance heating blocks that are connected to the product supply passage; such a heater being of the type used in coffee machines. The heating block is a thermal energy storage device that heats the product as it passes through the heating block. This requires a constant supply of electrical power to heating block in order to maintain it at a certain temperature, thereby wasting electrical energy and losing thermal energy to the environment. In general, conventional on-demand heaters are inefficient, among other reasons, because they heat the product indirectly. Furthermore, heaters with heating blocks where the product is passed through the block are in general undesirable for the heating of wet food due to difficulties in cleaning the heating block. Hence, an increased risk of contamination exists. Furthermore, for heating of wet product comprising larger size particles, there is an increasing risk of blockage of the heating block.

Swiss Patent 679 722 describes an industrial device for the warming of liquids, in particular milk, which comprises at least one microwave generator, at least one liquid conduit and a rectangular wave-guide which is crossed by the liquid conduit disposed in intersection with the wave-guide. However, the device is not suitable for a dispensing machine which would provide heated food on demand. Moreover, in the device, the electromagnetic energy is fed from two longitudinally spaced apart locations of the wave-guide and enters the wave-guide in a direction situated at right angle with respect to the longitudinal direction along which the wave-guide mainly extends. Bouncing and multiple modes of the electromagnetic energy are created within the wave-guide which would cause problems to control the reflected microwaves and also a relatively poor heating efficiency for a satisfactory use in on-demand dispensing machine.

U.S. Pat. No. 2,585,970 relates to an apparatus for heating fluids in industrial conditions by means of ultra high-frequency dielectric heating in which a low section tube is passed into a relatively large chamber which is orthogonally fed by a microwave field. This solution is not suitable to be implemented in a public dispensing machine for heating a fluid product on-demand as multiple modes are created consequently to the fact that the energy is fed from the side of a large chamber which has a cross-section of about one-half wavelength in diameter. Multiple modes in such a large chamber would result in a lack of efficiency and in a relatively important loss of energy which would fail to rapidly heat food products circulating at a high flow rate such as it is requested in on-demand food dispensing machine. The large chamber would also be too cumbersome to fit in the restricted room usually left available in the dispensing machines.

Other methods and apparatuses for reheating food products by electromagnetic energy are known which would not be well adapted to heat liquid or viscous products circulating in a dispensing machine such U.S. Pat. No. 3,336,142 or U.S. Pat. No. 5,589,093.

Thus, there is a need for heating devices which overcome these drawbacks, and the present invention provides such devices.

In particular, there is a need to propose an efficient solution which can be easily implemented in dispenser systems for rapidly heating viscous or liquid food products at a desired warm temperature of consumption and at relatively high flow rate as it is generally required in the conditions of on-demand dispensing systems.

SUMMARY OF THE INVENTION

The present invention relates to a dispenser which utilizes a heating device that has superior performance compared to conventional tank and on-demand heaters.

This device prevents degradation of the product by holding the product at ambient temperature while heating on-demand. This extends the possibility of supplying a constant quality of the dispensed product.

The invention also provides a dispenser system that reduces the risk of microbiological contamination. In particular, that problem that may exist in the area where the product package or bag is connected to the dispenser.

The invention also proposes a novel system that includes a relatively simple and small heating device which can find its place in restricted space of any usual vending machine or sauce dispenser.

Accordingly, what the invention provides is a dispenser for dispensing a heated wet food or beverage comprising a housing configured and dimensioned for receiving the wet food or beverage, a heating device including an electrical power supply and a magnetron configured to supply electromagnetic energy in the microwave range to a wave-guide, and a heating passage configured to supply a wet food or beverage on-demand and arranged to intersect the wave-guide, to heat the wet food or beverage when electromagnetic energy is applied within the wave-guide, wherein the wave-guide has an elongated hollow shape and has an inlet for supplying the electromagnetic energy which is provided at a first end of the wave-guide so as to guide the electromagnetic energy substantially in forming standing waves along the longitudinal direction of the wave-guide while the other end of the wave-guide has a shorted end. Such a feeding configuration of the electromagnetic energy oriented in a longitudinal direction and also specifically in relation to the heating passage has proved to be particularly efficient to heat rapidly and efficiently with a minimum of energy loss a liquid food product circulating at relatively high flow rate in the heating passage. One important advantage of having a standing wave configuration is that we can tap the maximum power where the electromagnetic field is always at the maximum; i.e., at a predetermined distance along the wave-guide. The shorted end and its position allow setting up the correct predetermined distance while minimizing the reflected energy to the magnetron. More specifically, it has been determined that the preferable distance for the heating passage to intersect the longitudinal direction of the wave-guide and where maximum power is received is about 0.75 time of the wavelength as measured from the shorted end.

In another embodiment, the invention relates to a method of producing a heated wet food or beverage. This method comprises the steps of providing a dispenser of the type described herein, supplying a wet food or beverage to the housing, conveying the wet food or beverage from the housing to the heating passage, passing the wet food or beverage through the heating passage, while simultaneously applying electromagnetic energy in a standing wave configuration to a first end of wave-guide along a longitudinal direction of the wave-guide to thereby generate heat within the wet food or beverage, and then dispensing the heated wet food or beverage through the dispenser head.

BRIEF DESCRIPTION OF THE DRAWINGS

The invention will now be described in more detail with reference to the drawings, wherein.

DETAILED DESCRIPTION OF THE INVENTION

Figure 1:
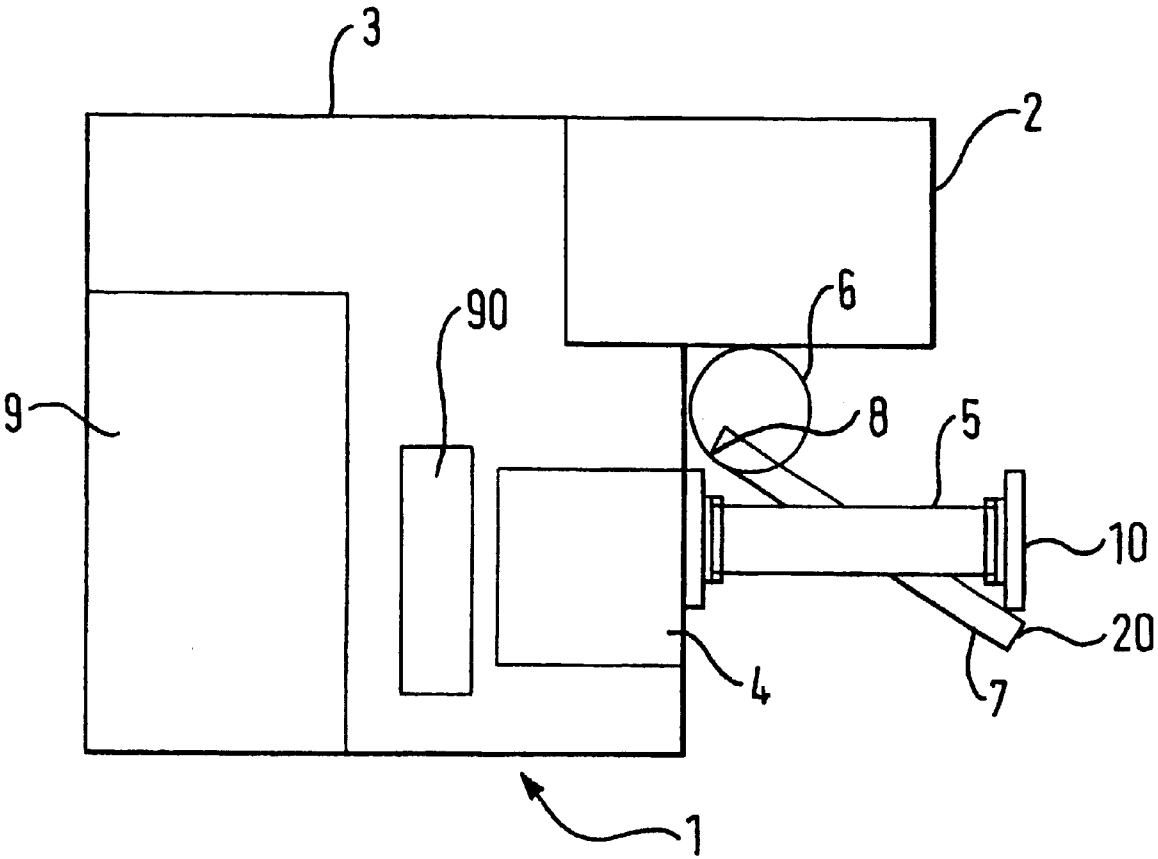
FIG. 1 is a system diagram of the dispenser system of the invention.

It is preferred that the dispenser is adapted for dispensing a wet food or beverage product from a package and the housing is capable of receiving the package. This provides a high degree of convenience to the user and an improved safety of the product provided.

Advantageously, the dispenser further comprises means for forwarding the wet food or beverage from the housing to the dispenser head. The forwarding means may be a peristaltic pump, a package squeezing mechanism, a gravity feed, or other means for moving the wet food or beverage from the housing to the dispenser head.

In a preferred embodiment of the invention, the heating passage in the wave-guide is designed so that it passes through the centerline of the wave-guide where the electric field intensity is at a maximum. A wet food, beverage or similar products received in the heating passage are exposed to the electromagnetic energy therein. The heating passage can be arranged at an angle of between 0 and 90 degrees with respect to the wave-guide. It has been found that a more efficient heating at the desired flow rate is obtained when this angle in the range of 22 degrees to 45 degrees, and more preferably in the range of 30 degrees to 35 degrees. Most preferably, this angle is about 32 degrees. When working in this preferred restricted range of inclination, we found that the scattering field strength was advantageously minimized due to a change in incident wave polarization and a better impedance match was consequently obtained. As a result of this more efficient heating parameters, it is possible to circulate the food product at a higher flow rate, about 100 to 200 g/min, while serving the product at the right warm temperature as it should normally be desired for the purpose of the service of warm food products on demand.

In a preferred embodiment, the heating passage comprises two portions of microwave reflecting tubes angularly assembled on opposite sides of the wave-guide and a flexible product delivery tube passing through the two portions of tube and intersecting the wave-guide. The function of the portions of microwave reflecting tubes is mainly to act as a shield against possible microwave energy leakage out of the wave-guide. The product delivery tube is of course made of a material transparent to microwave such as plastic or rubber and it is disposed coaxially within the portions of tubes.

"Electromagnetic energy in the microwave range" in the present specification means energy having a frequency from about 300 to 300,000 MHz. It is preferred that the frequency of the electromagnetic energy is in the range from 300 to 30,000 MHz, conveniently from 1000 to 3000 MHz. Favorably, the frequency is in the range of 2400 to 2500 MHz, preferably about 2450 MHz. Alternatively, the energy may be at any frequency that can be absorbed by the wet food or beverage.

The dispenser of the invention is particularly suitable for viscous wet food products having a viscosity in the range of 60,000 to 160,000 centipoise at a shear rate of 1 reciprocal sec. and a flow index of 0.2 to 0.5. Typical viscous products include sauces and gravies, in particular cheese or tomato sauces. If desired, the dispenser can also be used for less viscous liquids such as coffee, tea, cocoa, hot chocolate or other beverages that are served and consumed when warm or hot.

To increase the security of the system, it is advantageous to provide an electric resistance heater fitted to or near the dispensing head. This helps keep the product that is present between the end of the heating passage to the dispensing tip at a temperature above about 140° F. (or about 60° C.). This arrangement avoids contamination that may arise in the outlet area of the dispensing head.

Conveniently, the method of heating the product is carried out in the following manner. The wet food or beverage is preferably provided in a package, pouch or bag which is arranged in a housing that is adapted for receiving it. The package, pouch or bag is attached to the heating passage by any suitable means. For example, the pouch can be attached by a tube connected by a fitting or spiking. The pouch can also be spiked or punctured so as to create communication between the package or bag and the heating passage, thus allowing the conveying of the wet food or beverage to the heating passage. When the package, pouch or bag is spiked, and the bag and dispenser connected in a closed system, a sanitary cycle is initiated by powering up the heater. A small quantity of product may be dispensed if necessary to flush the system. This may be done for example by activating the product forwarding means, which may be a pump such as a peristaltic pump or similar device, for an appropriate period of time. Valve means may be provided to selectively close the dispensing tube when the forwarding means are in a shut-off position.

When demand occurs, the wet food or beverage is passed through the heating passage, e.g., by means of the pump. Simultaneously, a magnetron is turned on and electromagnetic energy in the microwave range is supplied to the wave-guide to thereby generate heat within the wet food or beverage product. The heated wet product is then dispensed via the dispensing head. A control system is provided so that pumping, thermalization or heating and dispensing starts when the dispenser is initiated and continues until the person operating the dispenser ceases dispensing of the product. Next, the pump and heater are turned off, optionally the valve means, if any, may be closed, and the system reverts to an idle mode.

It is desirable to have pumping means that is capable to circulate the wet food or beverage at a flow rate of at least 50 g/min and preferably of about 200 g/min. Importantly, it must be noted that due to the specific longitudinal configuration of the wave-guide and its microwave feeding with respect to the slanted orientation of the heating passage, the invention has proved to be sufficiently effective at 500-watt power for heating the food product at a temperature of about 150° F. (about 65.6° C.) for a 200 grams-per-minute-flow rate.

Turning now to the drawing figures, FIG. 1 shows a dispenser 1 for dispensing heated a wet food or beverage from a pouch 2. The dispenser 1 comprises a housing 3 which is capable of receiving the wet food or beverage and a heating passage 7 including an inlet opening 8 configured to receive the product into the heating passage 7. The dispenser has a heating device 9, which includes an electrical power supply configured to supply electromagnetic energy in the microwave range to a wave-guide 5. The supply comprises a power transformer, a filament transformer, a capacitor, and a diode. A magnetron 4 generates the microwave energy and is coupled to the wave-guide 5.

The heating passage 7 is arranged so that it intersects the wave-guide 5 to heat the wet food or beverage when electromagnetic energy is applied to it in the heating passage.

The pouch 2 containing the cold beverage or wet food product is installed in a chamber of the dispenser and is connected to a product delivery tube 25. The wet food or beverage product is passed through a peristaltic pump 6 and sent through the wave-guide 5 and heating passage 7 to a dispenser head 20. The peristaltic pump 6 assists the forwarding of the product in the product delivery system and is particularly useful for handling viscous products.

Figure 3:
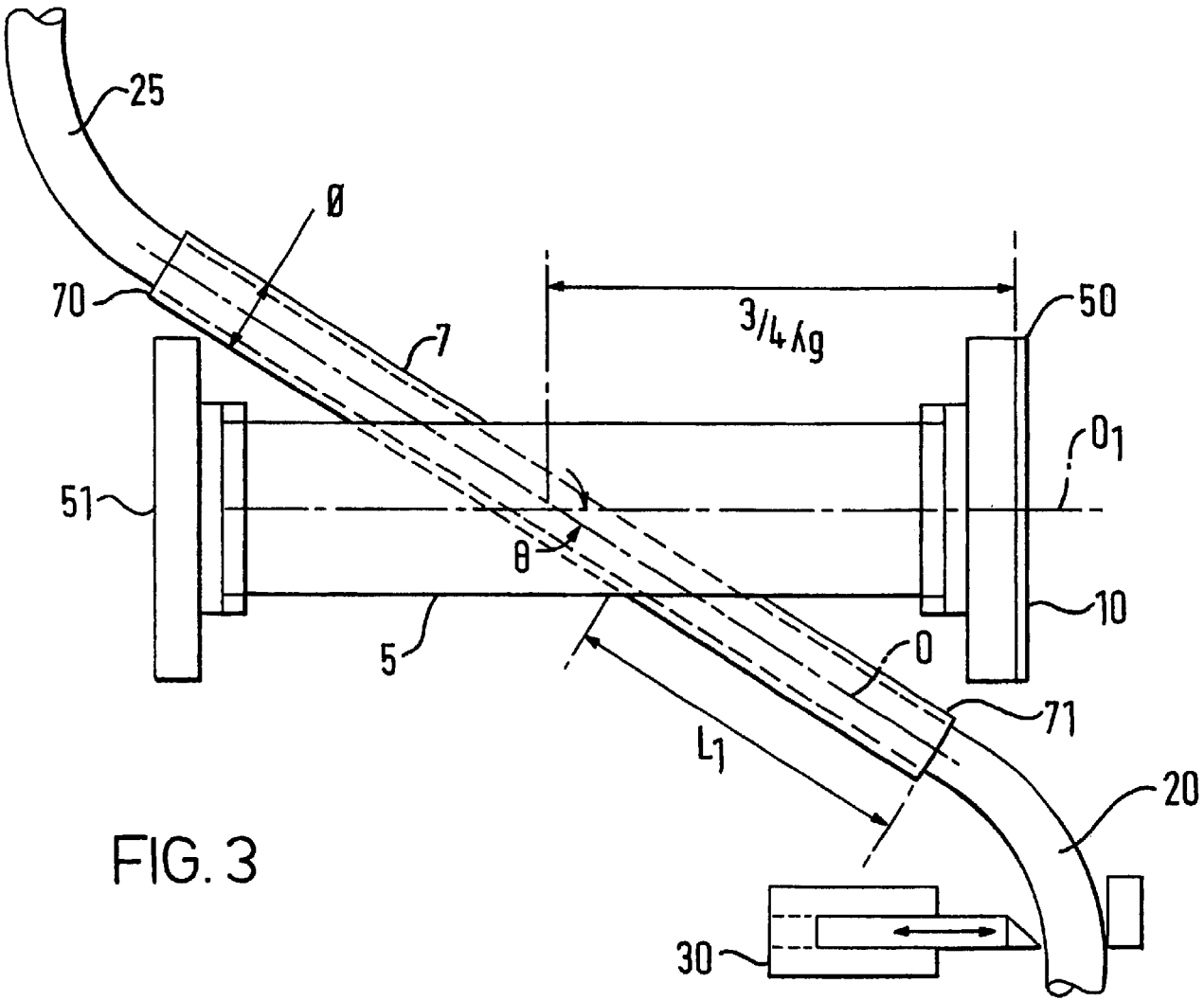
FIG. 3 is a side view of an enlarged system diagram of the heating passage in the wave-guide of FIG. 1.

The dispenser head 20 is configured to receive the heated wet food or beverage product from the heating passage and arranged to dispense it. The dispensing head may be of conventional type known from sauce, condiment or beverage dispensing art. The dispensing head may advantageously be the lower end portion of the dispensing tube 25 onto which is connected a valve means 30 as shown in FIG. 3.

The dispenser is provided with a cooling fan 90 to regulate the temperature within the dispenser. The present application is a microwave applicator within the wave-guide for providing microwave energy to a load, which flows on demand.

Figure 2:
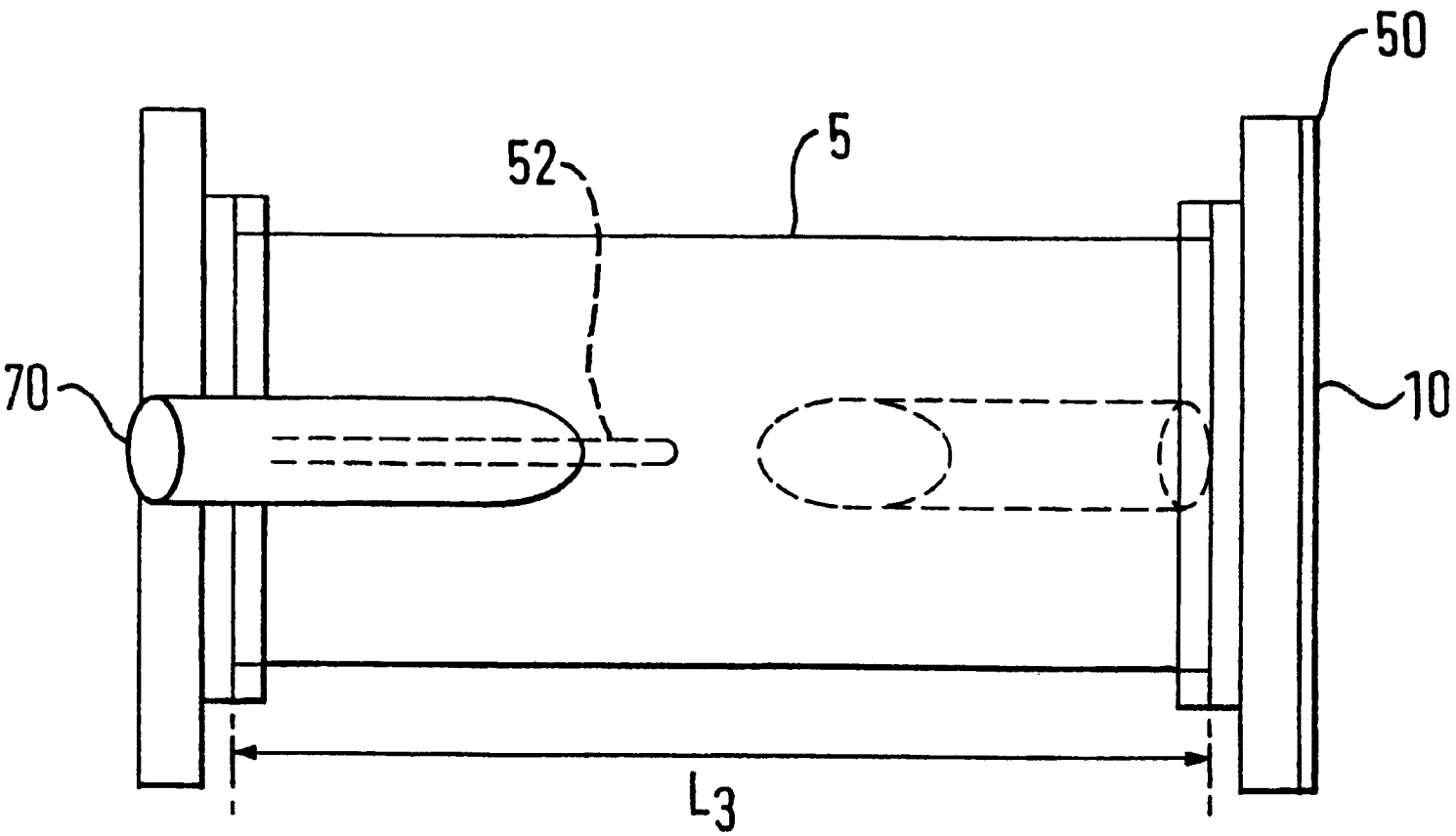
FIG. 2 is a top view of an enlarged system diagram of the heating passage in the wave-guide of FIG. 1.

FIG. 2 illustrates in further details a preferred embodiment of the wave-guide 5. The wave-guide is preferably shaped and sized as an elongated portion of tube to promote an even microwave field passing through the portion of the heating passage which intersects the wave-guide as opposed to multi-modal fields of the prior art where reflections over various part of the wave-guide are much greater.

For instance, the wave-guide 5 is a cut piece of WR340 rectangular wave-guide (having a cross-section of 3.40 by 1.70 inches). Two portions of tubes 70, 71 of diameter "Φ" comprised in a range of 0.25 to 1.2 inch (6,35 to 30,48 mm) and of length "$L_1$" comprised in a range of 1 to 2 inch (25,4 to 50,8 mm) are assembled, preferably welded, on opposite sides, at the center of the broad wall of the wave-guide at an angle "0" comprised between 0 to 90 degrees, preferably between 22 to 45 degrees, even more preferably between 30 to 35 degrees. The heating passage 7 is defined by the assembly of the tubes 70, 71 which also comprises the continuous delivery tube 25 which can be a flexible plastic tube, for instance, passing through the two portions of tubes 70, 71 and intersecting the wave-guide at the centerline $\mathbf{0}_1$. The portions of tubes 70, 71 act as a shield to the microwave so that no leakage is possible out of the wave-guide. The length of the portions is determined as a function of the diameter of the portions in order to prevent that leakage's problem. In particular, the higher the diameter is, the longer the portions should be.

Due to constructive interference, it is most advantageous to maintain a distance of ¾ λg (three quarter of the wavelength) measured from the terminating end 50 of the wave-guide 5 to the longitudinal axis 0 passing through the two welded tubes 2, and the intersection of the axis or centerline $\mathbf{0}_1$ of the wave guide 5. The specific positioning of the tubes provides an optimal microwave energy which is obtained when the wet food or beverage product is passed through the wave-guide 5. Openings may be provided in the wall of the wave-guide 5 through the tube where the tubular portions 70, 71 are welded. A short circuit plate 10 is assembled at the terminating end 50 of the wave-guide 7 so as to create a shorted end where the microwave field is broken off. Furthermore, a slot 52 may be provided along the wave-guide and in the vicinity of the magnetron so that a tuning stub can be installed therein to reduce the reflected power which may return in a direction toward the magnetron.

An electric resistance heater (not illustrated) fitted to the dispensing head can be advantageously provided to the device so as to keep the product between the end of the heating passage to the dispensing tip above 140° F. (about 60° C.).

The magnetron 4 and the power supply 9 are sized based on the dielectric properties of the product being dispensed and the flow rate of food product desired. Conveniently, control means for the dispenser 1 are integrated. The dispenser 1 may be provided with a single push of a switch, which activates the microwave generation and starts the pump 6 immediately or with a slight delay of 1 to 10 seconds. A valve mechanism 30 can be further installed at the dispensing end of the dispensing tube 25. The valve mechanism is preferably coupled via the control system to the peristaltic pump so that the valve mechanism opens when the peristaltic pump is actuated and closed at the time the peristaltic pump is shut off.

Due to the special configuration and relative position of the wave-guide 5 and the heating passage 7, an efficient and even heating of continuously flowing product within the heating passage may be obtained.

The wave-guide may encompass various cross sectional shapes such rectangular, circular or polygonal cross sections.

Although the invention has been described in connection with a preferred embodiment, it is not so limited. Numerous variations within the scope of the appended claims will be apparent to those skilled in the art, and it is intended that the claims cover all such variations.

What is claimed is:

1. An on-demand heated wet food or beverage product dispenser, comprising:

a housing configured and dimensioned for receiving the product;

product delivery tubing connected with the housing for delivering the product from the housing;

an elongated wave-guide having first and second opposite longitudinal ends, the second end being shorted, wherein the wave-guide comprises an inlet for supplying the electromagnetic energy at the first end;

a heating device including an electrical power supply and a magnetron configured to supply electromagnetic energy in the microwave range to the wave-guide inlet, wherein the heating device and wave-guide are configured for guiding the electromagnetic energy substantially in standing waves along the longitudinal direction of the wave-guide, wherein the shorted second end is configured for shorting the electromagnetic energy to produce a standing wave of a predetermined wavelength;

a heating passage configured to supply the product from the product delivery tubing and intersecting the wave-guide between the first and second ends at about a ¾ wavelength station of the standing wave to heat the product when electromagnetic energy is applied within the wave-guide, wherein the heating passage is inclined with respect to a longitudinal direction between the first and second ends at an angle for increasing exposure of the product to the electromagnetic energy; and a dispensing head associated with the heating passage to receive the heated product from the heating passage and arranged to dispense the heated product in a condition for consumption thereof;

wherein the dispenser is configured for dispensing the product on-demand.

2. The dispenser of claim 1, wherein the heating passage is arranged with respect to the wave-guide at an angle between 22 degrees and about 45 degrees for exposing the product received in the heating passage to the electromagnetic energy.

3. The dispenser of claim 2, wherein the heating passage is disposed at an angle between about 30 and about 35 degrees with respect to the wave-guide.

4. The dispenser of claim 1, wherein the heating passage is arranged to intersect the longitudinal centerline of the wave-guide at a distance of about ¾ of a wavelength of the standing wave from the first end.

5. The dispenser of claim 1, wherein the housing is configured to receive a package containing the product, and the dispenser is adapted for dispensing the product from the package into the heating passage.

6. The dispenser of claim 1, further comprising a pump configured for pumping the product from housing to the dispenser head.

7. The dispenser of claim 1, further comprising a dispensing head heater associated with the dispensing head to maintain the product above a predetermined temperature in the dispensing head.

8. The dispenser of claim 7, wherein the dispensing head heater comprises an electric resistance configured for maintaining the product above about 60° C. during dispensing.

9. The dispenser of claim 1, wherein the heating passage comprises microwave-reflecting tubes disposed adjacent and on opposite sides of the wave-guide and a flexible product delivery tube extending through the microwave reflecting tubes and through the wave-guide.

10. The dispenser of claim 1, wherein the frequency of the electromagnetic energy is between about 300 and 30,000 MHz.

11. The dispenser of claim 1, wherein the heating device and heating passage are operable on demand for supplying and heating the product to a heated temperature and for allowing the product to remain at a temperature lower than the heated temperature between demands.

12. The dispenser of claim 1, comprising a switch controllable by a user configured for activating and deactivating the magnetron and the product flow through the heating passage.

13. The dispenser of claim 1, wherein the heating passage is tubular.

14. The dispenser of claim 1, wherein the heating device is configured for reducing or eliminating multi-modal electromagnetic fields.

15. A method of producing a heated wet food or beverage product on demand, comprising:

producing microwave electromagnetic energy in a standing wave in a wave guide;

conveying a wet food or beverage product through a heating passage at about a ¾ wavelength station of the standing wave in the wave guide and at an inclination with respect to the wave guide at an angle to increase exposure of the product to the electromagnetic energy to heat the product; and dispensing the heated product through a dispenser head in a condition for consumption thereof.

16. The method of claim 15, wherein the providing of electromagnetic energy comprises applying the electromagnetic energy in the wave guide at a first wave-guide end and producing a standing wave with a shorted second wave-guide end, wherein the product is conveyed through the heating passage at about ¾ of the wavelength of the standing wave from the first end.

17. The method of claim 15, further comprising:

dispensing the heated product from the dispenser head; and heating the dispenser head to maintain the temperature of the dispensed product at above about 60° C.

18. The method of claim 15, further comprising:

placing in a housing a package containing the product; and conveying the product from the housing to the heating passage.

19. The method of claim 15, wherein the conveying of the product comprises conveying the product through the wave-guide at an angle to the wave-guide in the between about 22 degrees and about 45 degrees.

20. The method of claim 15, wherein the conveying of the product beverage comprises pumping the product through the heating passage.

21. The method of claim 20, wherein the pump and electromagnetic energy are activated and upon receiving a demand for the product.

22. The method of claim 15, wherein the flow and standing wave are started and stopped substantially together in response to a demand.

* * * * *

UNITED STATES PATENT AND TRADEMARK OFFICE

CERTIFICATE OF CORRECTION

PATENT NO. : 6,433,320 B1
DATED : August 13, 2002
INVENTOR(S) : Douglas J. Dudgeon et al.

It is certified that error appears in the above-identified patent and that said Letters Patent is hereby corrected as shown below:

Column 20,
Line 58, "Numbers $E_T$ being" should read -- Number, $E_T$ being --.

Signed and Sealed this

Twenty-first Day of January, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,433,320 B1
DATED : August 13, 2002
INVENTOR(S) : Larry Bartoletti et al.

It is certified that error appears in the above-identified patent and that said Letters Patent is hereby corrected as shown below:

This certificate supersedes Certificate of Correction issued January 21, 2003, the number was erroneously mentioned and should be vacated since no Certificate of Correction was granted.

Signed and Sealed this

Twenty-fifth Day of March, 2003

JAMES E. ROGAN
*Director of the United States Patent and Trademark Office*